US006354541B1

(12) United States Patent
Achleitner et al.

(10) Patent No.: US 6,354,541 B1
(45) Date of Patent: Mar. 12, 2002

(54) DEVICE FOR LOCKING END POSITIONS OF MOBILE SWITCH PARTS

(75) Inventors: Herbert Achleitner, Graz; Josef Hörtler, Knittelfeld, both of (AT)

(73) Assignee: VAE Aktiengesellschaft, Vienna (AT)

( * ) Notice: Subject to any disclaimer, the term of this patent is extended or adjusted under 35 U.S.C. 154(b) by 0 days.

(21) Appl. No.: 09/424,460

(22) PCT Filed: May 27, 1998

(86) PCT No.: PCT/AT98/00136

§ 371 Date: Nov. 24, 1999

§ 102(e) Date: Nov. 24, 1999

(87) PCT Pub. No.: WO98/54041

PCT Pub. Date: Dec. 3, 1998

(30) Foreign Application Priority Data

May 27, 1997 (AT) ..... 902/97

(51) Int. Cl.[7] ..... E01B 7/02
(52) U.S. Cl. ..... 246/448; 246/415 R
(58) Field of Search ..... 246/415 R, 443, 246/448, 449, 450, 451, 452

(56) References Cited

U.S. PATENT DOCUMENTS 4,586,425 A * 5/1986 Redman et al. ..... 91/45
4,703,958 A 11/1987 Fremy
5,462,245 A * 10/1995 Durchschlag ..... 246/448
5,730,395 A * 3/1998 Carmes ..... 246/448

FOREIGN PATENT DOCUMENTS

EP 0 603 156 A1 6/1994

* cited by examiner

*Primary Examiner*—S. Joseph Morano
*Assistant Examiner*—Robert J. McCarry, Jr.
(74) *Attorney, Agent, or Firm*—Kevin E. Joyce

(57) ABSTRACT

A device for locking the end positions of movable railway switch parts in which two parts axially displaceable relative to each other are displaced into a position coupled to each other for movement in at least one direction. The relatively displaceable parts, formed by a tube and a rod guided within the tube, are arranged at least partially within a stationary external tube. Locking elements comprising balls cooperate with the axially displaceable parts and the external tube and are displaceable radially into a lock position within a recess of the external tube. The balls are surrounded by a ring resiliently held in a position having an outer diameter smaller than, or equal to, the outer diameter of the axially displaceable tube retained in a peripheral groove of the tube. The balls are arranged in openings in the tube between the rod and the ring.

14 Claims, 9 Drawing Sheets

DEVICE FOR LOCKING END POSITIONS OF MOBILE SWITCH PARTS

BACKGROUND OF THE INVENTION

1. Field of the Invention

The invention relates to a device for locking the end positions of movable railway switch parts, in particular a switch lock, in which two parts capable of being axially displaced relative to each other are displaceable into a position coupled to each other in a positive and force-transmitting manner in at least one moving direction, wherein the relatively displaceable parts are formed by a tube and a rod guided within the tube and are arranged at least partially in a stationary external tube, wherein locking elements comprised of balls cooperate with the axially displaceable parts and the external tube and are displaceable in the radial direction into a lock position into a recess or internal ring groove of the external tube.

2. Prior Art

A device of the above-mentioned kind has already become known from EP-A 603 156, in which locking elements comprised of balls are pressed into their lock positions by means of stops comprised of thickened rod regions, said locking elements in the lock positions lying in a recess of the external tube and on a partial rod region formed with the full diameter. The balls pass through openings of the tubes surrounding the rod and being respectively connected with a tongue such that a relative displacement of that structural part connected with the tongue, i.e., the tube, relative to the external tube will be effectively prevented if the balls are pressed into their outer positions, thus effecting locking between the external tube and the tubular structural part. To undo such a lock, the rod must be displaced, whereby the ball can fall back onto regions having smaller diameters, thus emerging from the lock position within the groove of the external tube.

In the known device only one side, i.e., the closed tongue, was appropriately locked at the line and the correct position of the open tongue was ensured by additional devices such as, for instance, a coupling rod. Such coupling rods, as a rule, are required by the pertinent rail authorities for safety reasons. While, during the displacement movement of the tongue, the forces to be taken up by the ball are limited by the maximum displacement force admissible, the balls may be strained by a multiple in the lock position. Switching forces, as a rule, are in the range of 150 kp, whereas the forces acting on the locking components may be in the range of 10,000 kp and more. Since those locking forces can be taken up by balls only via a line point contact, the points of contact are exposed to an excessively high load, which may lead to inadmissible deformations.

SUMMARY OF THE INVENTION

The invention aims to improve the function in a device of the initially defined kind and also guarantee the absorption of extremely high locking forces without the risk of premature impairment of the function of the locking means. To solve this object, the configuration according to the invention essentially consists in that the balls are encompassed by an expandable ring or a ring comprised of segments, that the segments or the ring, respectively, are resiliently held in a position having an outer diameter smaller than, or equal to, the outer diameter of the axially displaceable tube guided within the external tube and are/is immersed in a peripheral groove of the tube, and that the balls are arranged in openings of the tube between the rod and the ring comprised of segments. Due to the fact that the balls no longer directly cooperate with the edges of the grooves of the external tube in the lock position, an extreme load on the edges is avoided and the accordingly high load is taken up by the ring segments or the expandable ring, which, in turn, may have appropriate cross sections in order to ensure surface contact on the side walls of the grooves that are effective for locking. By those segments being resiliently pulled inwards, it is safeguarded simultaneously with a displacement of the rod into a position in which the balls can recede onto a region of reduced cross section, that this radially inwardly directed movement of the balls is assisted by the force of the springs such that, in the following, a minimum displacement resistance between the structural part coupled with the tongue and the external tube will be ensured. To this end, the segments of the ring are immersed in a peripheral groove of the tube with the balls themselves being guided in radial openings of the tube, as in the known configuration.

Advantageously, the configuration is devised such that the ring segments have end faces extending normal to the axial displacement direction or inclined at an acute angle, which end faces cooperate with the stops of the external tube in the lock position so as to ensure the effective and reliable support of high locking forces in the lock position.

In a particularly simple manner, the spring of the ring segments may be constituted by springs extending in the peripheral direction or a spring band. In principle, the individual ring segments may be interconnected by separate springs, wherein a configuration comprising an externally peripheral continuous spring band is particularly simple to produce.

In order to further enhance safety, and not only lock the respectively closed tongue but, at the same time, also be able to lock the respectively open tongue in an appropriate position, the configuration advantageously is devised such that the rod in its end region comprises two axial regions reduced to smaller diameters and an intermediately located axial region having the full diameter, whose axial length is smaller than the distance of two balls neighboring in the axial direction of the tube. With such a configuration, a plurality of planes adjacent in the axial direction may, thus, be utilized as locking planes and a large displacement path with suitable locking of the end positions may be reached at compact structural dimensions. In a particularly advantageous manner, the configuration is devised such that each axially displaceable tube respectively connected with a switch tongue includes openings at an axial distance ($l_1$) which are offset in the axial direction and that the external tube comprises at least two stops so as to be opposed to each other at an axial distance ($l_2$)>($l_1$) and located on a radius exceeding the diameter of the internal tube, the distance ($l_2$) reduced by the distance ($l_1$) corresponding to the axial displacement path between the closed and open end positions of a tongue. With such a configuration, locking of the open tongue by an internally arranged plane of balls and segments, and locking of the tongue being in the abutment position by an externally arranged plane of balls and segments, may each be ensured, wherein it can be safeguarded, at the same time, that the respectively desired direction of locking will be obtained in both cases. In other words, this means that the tongue being in the closed position is secured against moving back into an open position and the tongue being in the open position is secured against moving into the closed position.

The device according to the invention for locking the end positions, at the same time, may be employed as an actuating means for displacing the tongues into the closed position or into the open position. Such a compact displacement actuator may be designed in a particularly simple manner in that the displaceable rod immersing into the tubes is continuously designed over its axial length and in a central region is connected with an actuating means, in particular a piston which is drivable in an axially displaceable manner by fluid within an external tube designed as the cylinder of a double-acting cylinder piston unit. The rod, thus, acts as a piston rod of a double-acting cylinder piston unit and, due to the two rings each arranged to be offset in the axial direction with their respective ring segments and the pertaining balls, one of the thus formed planes may each be utilized for the displacement actuator and/or the lock. In the lock position, the balls rest on a partial region of the rod having the full diameter and, therefore, can in no event be displaced in the axial direction at a displacement of the rod, being locked in the peripheral groove of the external tube. If such an external locking plane consisting of balls and ring segments is subsequently brought into an unlock position by displacement of the rod, those same balls cannot be used for displacement actuation of the tube connected with the tongue, if they abut on the end-side region of the rod. Rather must a stop shoulder of the region, that is located on a larger diameter subsequently seize the internally located balls for displacement actuation and, in this manner, entrain the external tube connected with the tongues over the displacement path of the tongues. That displacement path extends as far as into a wider region of the external tube, in which the balls can again step through outwardly and come out into a new lock position for the then open tongue, the displacement of the tongue out of that opened position being prevented in this manner. As already mentioned, the full-diameter axial region provided in the end region between two reduced to a smaller diameter must have an axial length smaller than the distance of two balls neighboring in the axial direction of the tube in order to safeguard that unlocking has occurred prior to commencing the displacement movement.

Advantageously, the configuration according to the invention is devised such that the external tube on each side of the cylinder comprises a further annular recess between the recess adjacent the cylinder for locking an end position of the tongues and the second recess for locking the opposite end position of the tongues, said further annular recess having a clear width that is smaller than the clear width of the locking recesses for securing the end positions. Such a configuration provides an additional safety if, for instance, the coupling rod has broken. In case of a fracture of the coupling rod, the displacement of an open tongue into the closed position will, in fact, no longer result in the synchronous displacement of the originally closed tongue into an open position, since it was the coupling rod that afforded such a forced coupling. Although the originally closed tongue likewise is moved into an open position by the stop shoulder and the balls, no correct open position will be ensured, which would be obtained only in the presence of a coupling rod. In such cases, the tensile load exerted on the balls becoming active for actuation in that event would suffice to shift those balls together with their ring segments into the further annular recess located therebetween, whereby further displacement is no longer feasible. If, as in accordance with a preferred embodiment of the invention, proximity sensors or displacement path-dependent switches are arranged on or near the cylinder end faces through which the piston rod passes, a signal signalling an incorrect position of the open tongue will be generated, from which a fracture of the coupling rod may be concluded.

In order to ensure the safe function and appropriate sequence of the respective displacement and locking steps, the configuration according to the invention in an advantageous manner is devised such that in an end position of the tongues the distance ($l_3$) of the balls facing the cylinder and resting on a smaller diameter of the rod from the stop formed by the axial region having the full diameter is chosen to be larger than the distance ($l_4$) of the externally located balls of the part of the rod located opposite the cylinder from the stop adjacent those balls and formed by the axial region having the full diameter. In that manner, it is safeguarded that in all cases in which the coupling rod fulfills its function any unintentional emergence of the leading balls into the intermediate recess of the external tube will be avoided and further movement will not be impeded in any manner. Only if the coupling rod has broken will those balls get on the respective counter stop of the region of the rod widening to the full diameter and, thereby, be brought into a position in which further displacement of the rod is no longer feasible, either.

Advantageously, the configuration according to the invention is devised such that in an end position of the rod the axial distance ($l_5$) of the balls resting on the full cross section in their lock position to the end-side region having a smaller diameter of the rod is larger than the distance ($l_6$) of the axially internal balls abutting on the full cross section on the opposite end of the rod from the internally arranged stop formed by the full cross section of the rod. Such a configuration allows for the desired sequence of movement, with the open tongue being unlocked first and then lock of the closed tongue being undone afterwards.

Advantageously, the axial width of the externally locked locking grooves of the external tube is larger than the axial width of the ring comprised of segments, thereby ensuring the safe entry of the segments under the pressure of the locking members, into the lock position of the external tube.

The device according to the invention, with minimal modifications and the use of largely identical structural parts, is suitable also for an embodiment in which the railway switch is trailable. In this case, a first unit facing away from the tongue end must be designed such that it can be opened under the force of the rolling load, wherein a suitable hydraulic coupling is able to undo the lock of the consecutive units. In this case, the configuration advantageously is devised such that, with the arrangement of a plurality of devices for locking the end positions acting in a spaced-apart relationship in the longitudinal rail direction, at least one device comprises locking elements capable of being displaced against the force of a spring and of being shifted outwards following a predetermined displacement path in the axial direction under the compression of the spring in the radial direction, releasing the further displacement path of the rod, and that the fluid volumes of the cylinder piston units of neighboring devices are interconnected to a piston displacement in same direction. Unlocking of that first unit facing away from the tongue end by overcoming the force of the spring, by fluid being pressed out into the respective working volumes of further units arranged in the direction towards the tongue end, results in the hydraulic unlocking of also those units, thus enabling resetting or switching by the rolling load when approaching the switch. The definitive lock of such a railway switch reset after approaching, however, must again be ensured by the appropriate hydraulic actuation of the rods in order to reliably reach the respectively required end position.

In a particularly simple manner, the configuration in those cases is devised such that the springs are designed as helical springs concentrically surrounding the piston rod and supported between the end walls of the cylinder piston unit and one spring plate each being displaceable within the external tube against a stop of the external tube, wherein the spring plate, which is displaceable within the external tube, in a manner distributed about its periphery carries balls that are radially displaceable in radial openings of the spring plate. Such a spring plate carrying the balls displaceable in the radial direction ensures that the compression stroke extends over a limited course only and, as a result, the free displaceability of the rod and hence complete unlocking are safeguarded. To this end, the balls in their spring plates are shifted into a radially outward position in which the spring need not be further compressed for further displacement of the rod.

The entrainment of the respective closed tongue into the open position is effected during approaching by displacement forces entering into action on the open tongue. In this embodiment, which relates to the switch regions that are located the farthest remote from the tongue ends, no additional tie rod or coupling rod is provided, as a rule, coupling rods usually being arranged near the switching actuator itself. Thus, in order to effect the displacement of the closed tongue into the open position without the wheel flange having to press open the closed tongue for that purpose, the configuration advantageously is devised such that the rod cooperating with axially acting springs on its end-side end faces carries a head having a diameter exceeding the diameter of the rods, which head cooperates with axially external stops of the tube.

BRIEF DESCRIPTION OF THE DRAWINGS

In the following, the invention will be explained in more detail by way of exemplary embodiments schematically illustrated in the drawing. Therein.

DETAILED DESCRIPTION OF PREFERRED EMBODIMENTS OF THE INVENTION

Figure 1:
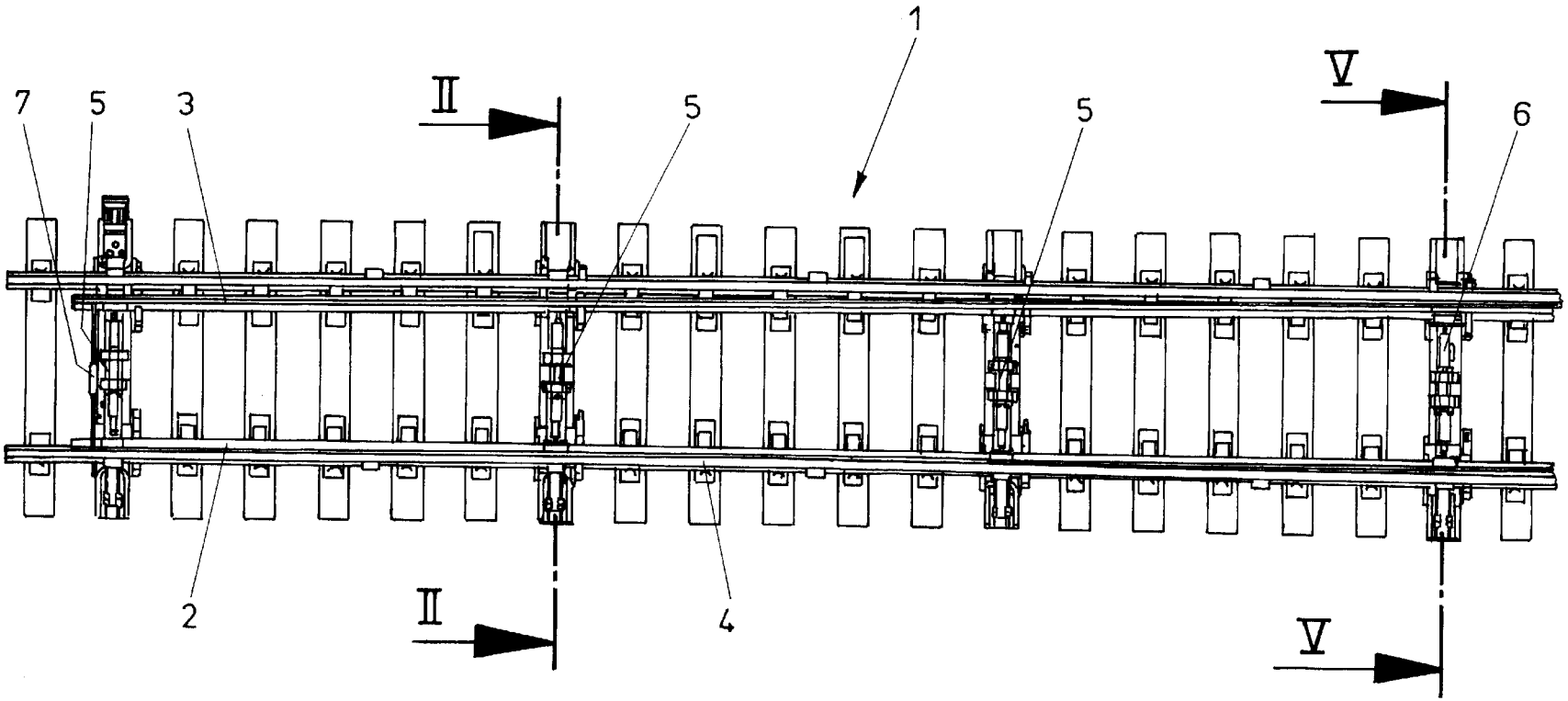
FIG. 1 is a top view on a railway switch comprising four units for locking the end positions.

FIG. 1 depicts a railway switch 1 with switch tongues 2 and 3 being provided. The switch tongue 2 is in its closed position on the continuous rails 4, whereas the switch tongue 3 in the illustration according to FIG. 1 is in its open position. Between the switch tongues 2 and 3 are respectively provided devices for displacing and locking the positions of the switch tongues 2 and 3, which are denoted by 5. The first such unit that is remote from the tongue end is denoted by 6, since that unit differs from the other units in terms of structure.

Figure 2:
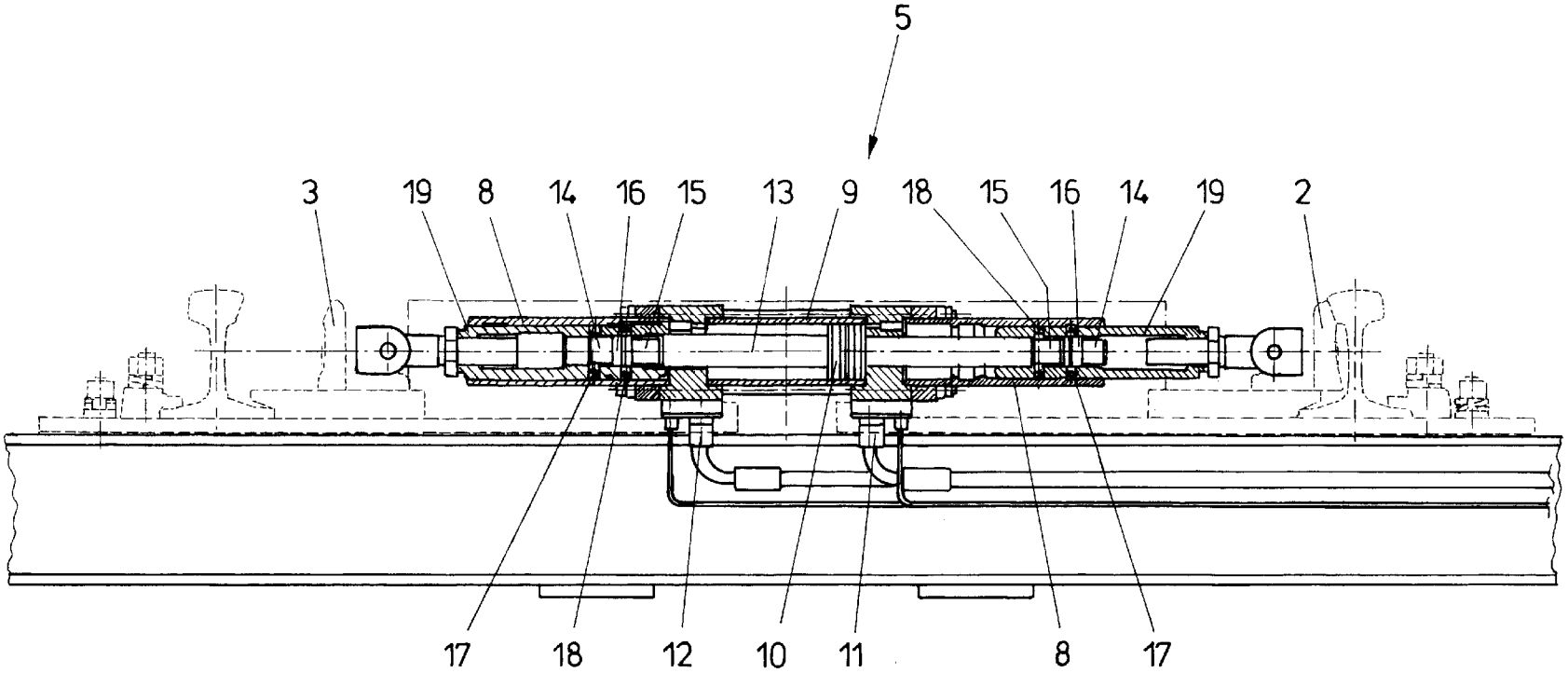
FIG. 2 is a section along line II—II of FIG. 1 through a unit for locking the end positions.

In the first device 5 adjacent the tongue ends, a coupling rod 7 is additionally visible, which during the displacement of one tongue safeguards the respectively corresponding movement of the second tongue in a positive and force-transmitting manner. The precise functions of the individual devices 5 and 6, respectively, are elucidated in the following detailed drawings. FIG. 2 depicts a device for locking the end positions of switch tongues, which, at the same time, also includes an actuating means for setting the switches. FIG. 2 corresponds to a section along line II—II of FIG. 1. Therein, the device 5 comprises an externally arranged tube 8, which extends to the left and to the right of a central region configured as a cylinder 9. In the interior of the cylinder 9, a hydraulically displaceable piston 10 is arranged, hydraulic fluid being pressed into the respectively active working volumes via hydraulic ducts 11 and 12. The piston 10 is connected with a throughgoing piston rod 13 having different cross sectional regions over its axial length. The end region of the piston rod 13 comprises two regions 14, 15 reduced to smaller diameters, between which a region 16 having the full cross section of the rod is provided. The regions 14, 15 and 16 each cooperate with balls 17 and 18 for locking or displacing that part which is connected with the tongue 3 or 2, respectively. The parts connected with the tongues 3 and 2 are formed by tubes 19 outwardly surrounding the piston rod 13 and again having openings for receiving the balls 17 and 18, respectively, in different cross sectional planes.

Figure 3:
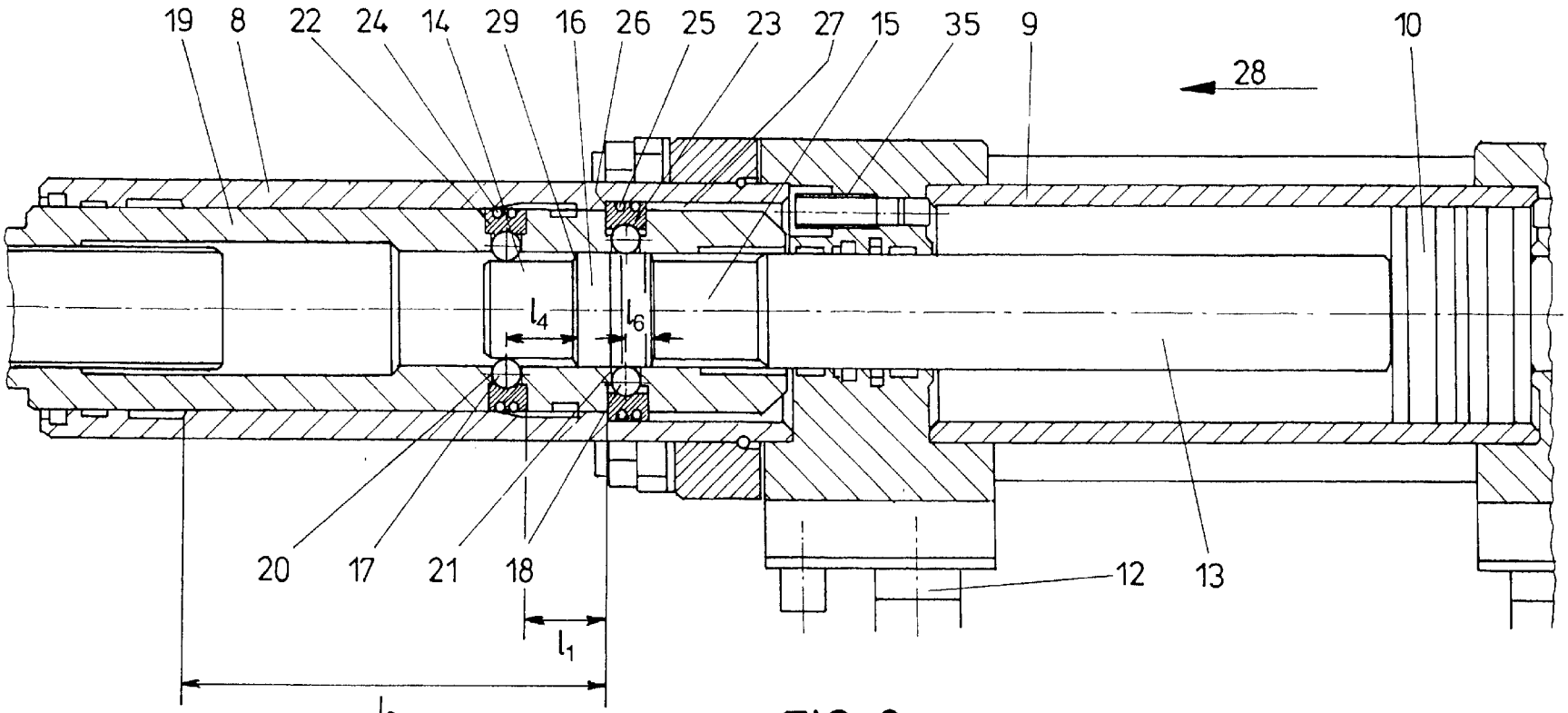
FIG. 3 depicts the enlarged left-hand partial region of FIG. 2 comprising the actuating means for the open tongue.

As illustrated in FIG. 3 on an enlarged scale, the balls 17 and 18, which are shiftable radially outwards within the tubes 19, are guided in openings 20 and 21 of the tube 19 connected with the respective switch tongue and supported against segments of a ring 22 and 23, respectively, which are shiftable outwards against the force of springs 24 and 25, respectively. The segments 22 and 23 in the peripheral direction make up a ring divided into segments.

Figure 4:
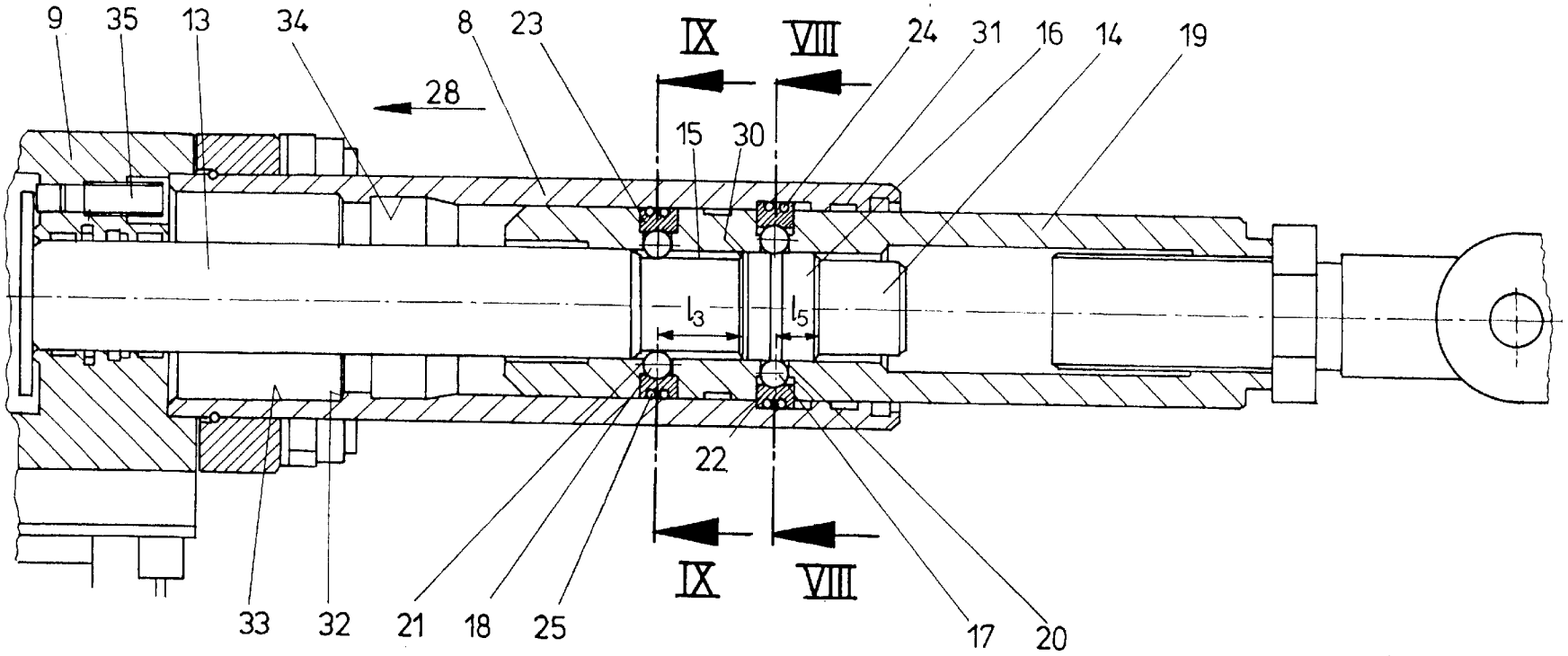
FIG. 4 is an enlarged representation of the right-hand partial region of FIG. 2 comprising the actuating means for the closed tongue.

The left-hand side of FIG. 2, which is illustrated in FIG. 3, is the side that is responsible for the lock position of the open tongue 3. The segments 23 as well as the pertaining balls 18 in this case are retained in the lock position by the axial region 16 of the piston rod 13 against a stop 26 in a recess 27 of the external tube, while preventing the displacement of the tube 19 connected with the tongue 3 from the open position of the tongue into a closed position by the stop 26 and the segments 23. That lock position for the open tongue can be undone only by displacing the piston rod 13 by the piston 10 in the direction of the arrow 28, thus causing the balls 18 to get on the smaller-diameter axial region 15 of the piston rod 13. Upon further movement of the piston rod 13 in the direction of the arrow 28, a stop shoulder 29 of the larger-diameter region 16 of the piston rod 13 enters into an operating connection with the balls 17 so as to cause the actuation of the switch tongue via the tube 19. At the same time, however, the displacement of the piston rod in the direction of the arrow 28 causes unlocking of the closed tongue as is illustrated in FIG. 4. The piston rod 13 reaches a position in which the externally located segments 22, which are in the lock position, under the force of their springs 24 can emerge from the lock position along with the pertaining balls 17, onto the piston rod end region 14 that is reduced to a smaller diameter, thus enabling the relative displacement of the tubular part 19 relative to the external tube 8. Upon further displacement of the piston rod 13 by fluid actuation of the piston 10 in the direction of the arrow 28, the internally located stop shoulder 30 of the axial region 16 having the full cross section, as a rule, will not enter into an operating connection with the balls 18, since the entrainment of the tongue is effected via the coupling rod. It is only in case of a fracture of the coupling rod that the stop shoulder 30 gets into an operating connection with the balls 18, thereby entraining the tube 19 in the direction of the arrow 28. Between the externally provided locking groove 31 and the internally provided locking groove 33 including a stop edge 32, a further recess or groove 34 reduced to a smaller clear cross section is provided, which enters into effect as the shoulder 30 cooperates with the balls 18. In that case the balls 18, in the course of displacement, enter the groove 34 together with the pertaining segments 23 and are secured against further displacement in a position in which no correct end position has been reached. Adjacent the end side of the hydraulic cylinder piston unit or cylinder 9 are provided sensors 35 which, in that case, will signal too large a distance of the tubular structural part 19 from the required end position, thus indicating a fracture of the coupling rod. In all other cases, the balls 18 are maintained in their internal positions by the springs 25 of the segments 23 so as to reliably reach the final lock position against a movement opposite the direction of the arrow 28, behind the edge 32 of the recess 33. In that position they will then be held again in their lock positions by the widened axial region 16. The arrangement of such an additional groove 34 makes sense naturally only in the immediate vicinity of a coupling rod, since otherwise no break of a coupling rod can be indicated.

Figure 5:
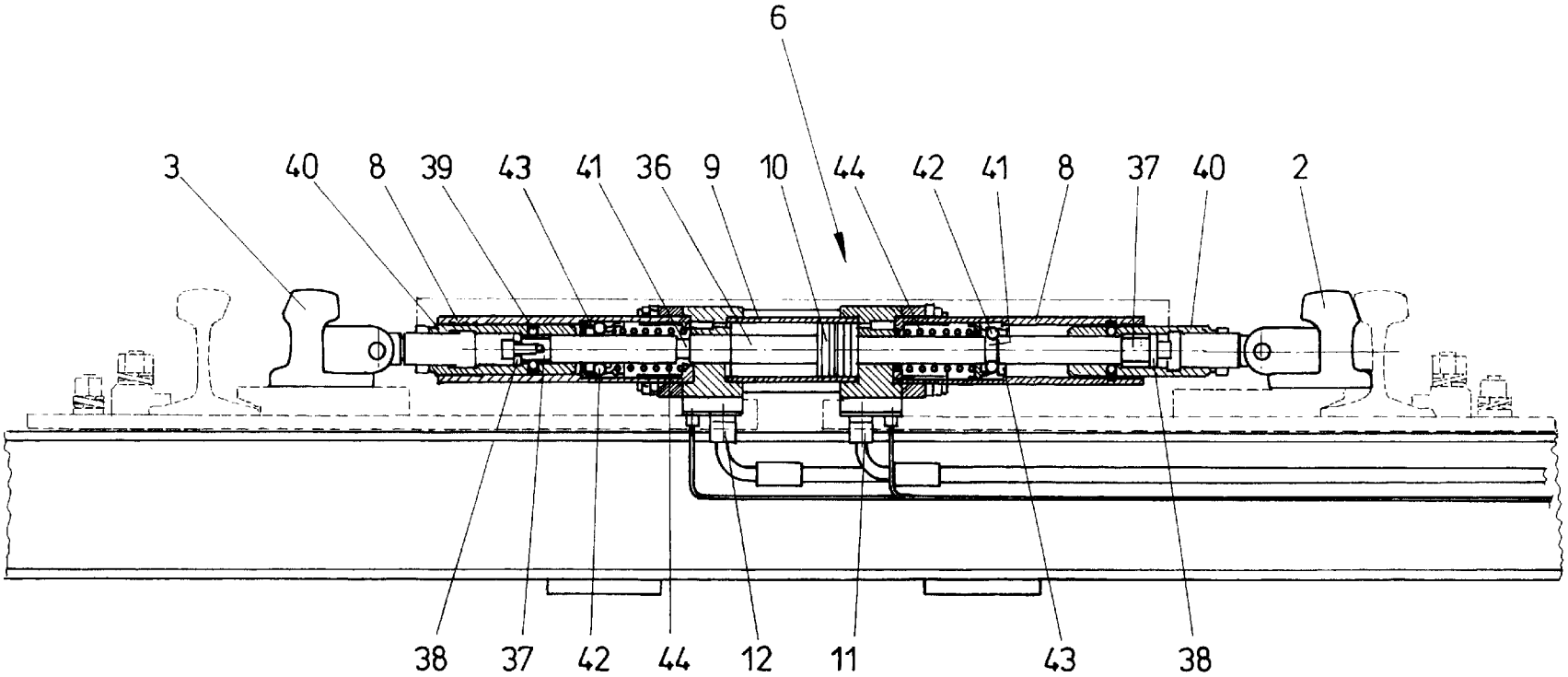
FIG. 5 is a section along line V—V of FIG. 1 through a locking unit capable of being opened against the force of springs.

In FIG. 5 a modified device 6 for locking the end positions of switch tongues 2, 3 is illustrated, the railway switch in this embodiment being trailable. FIG. 5 corresponds to a section along line V—V of FIG. 1. For identical structural parts the reference numerals of the preceding Figures have been retained. Also the device 6 comprises a piston rod 36 which has different cross sectional regions over its axial length. The end region of the piston rod 36 comprises a region 37 reduced to a smaller diameter with a head 38 being each attached to end-side end faces of the piston rod 36, said head having a diameter exceeding that of the rod. The region 37 cooperates with balls 39 for locking or displacing the tube 40 connected with the switch tongue 2 or 3, respectively, which again includes openings for receiving balls 39. Peripheral grooves 41 cooperating with balls 42 are provided in the piston rod 36, said balls 42 being axially displaceable against the force of a spring 44 in one spring plate 43 each. As is apparent from FIG. 6, which is an enlarged cutout of the left-hand half of FIG. 5, the spring 44 is supported between the end wall 45 of the cylinder piston unit 9 and the spring plate 43 displaceable within the external tube 8, wherein the spring plate includes radial openings for receiving the balls 42. The balls 42 are guided on a ring 46 supported in the external tube 8 and having regions of different internal diameters in the axial direction, whereby, in the axial displacement of the balls 42 the latter may also be shifted radially. A region 47 having the full rod cross section is provided between the region 37 of the piston rod 36, that is reduced to a smaller diameter and the peripheral groove 41.

Figure 6:
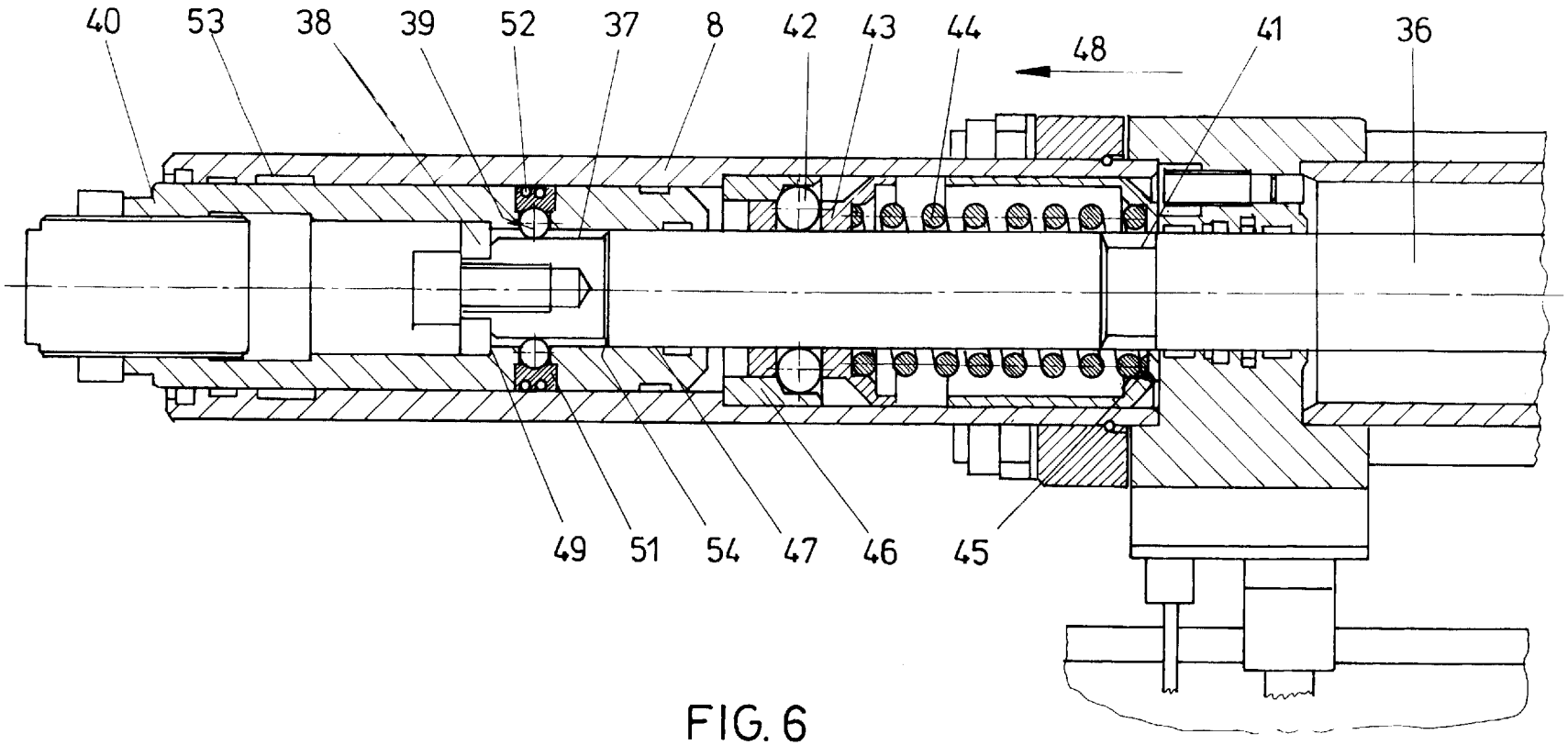
FIG. 6 is an enlarged illustration of the left-hand partial region of FIG. 5 for the actuating means of the open tongue.
Figure 7:
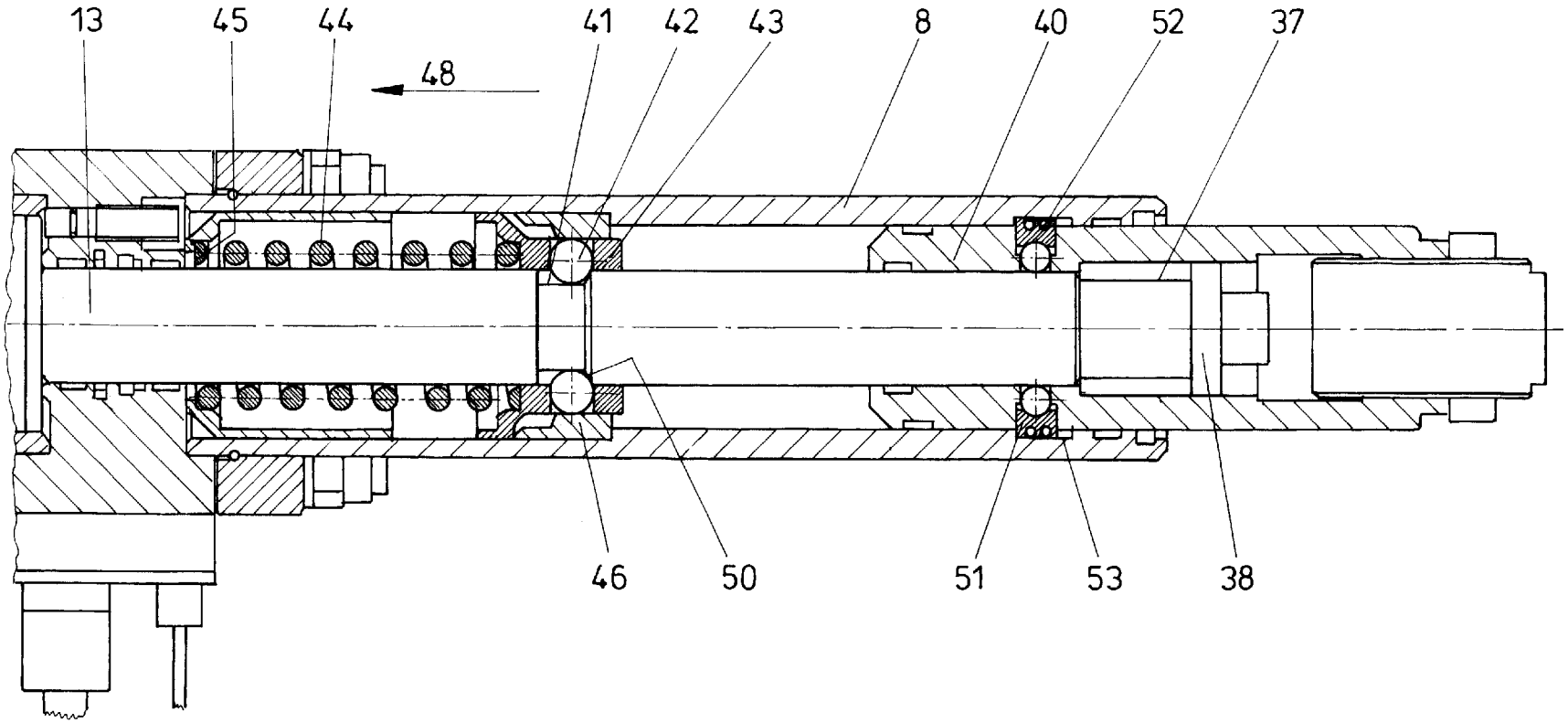
FIG. 7 is an enlarged illustration of the right-hand portion of FIG. 5 comprising the actuating means of the closed spring tongue.

Unlike the configuration of the device 5 shown in FIG. 3, the device 6 according to FIG. 5 is locked only on the side of the tongue closure. FIG. 6 depicts the unlocked left-hand side of FIG. 5, wherein the open tongue 3 is moved in the direction of the arrow 48 together with the tube 40 as a rolling load approaches. The piston rod 36 is entrained in the direction of the arrow 48 by the tube 40 via the stop 49 which cooperates with the head 38 of the piston rod 36. At the same time, displacement of the piston rod 36 in the direction of the arrow 48 against the force of the spring 44 is effected as illustrated in FIG. 7 of the right-hand side of FIG. 5, since the balls 42 which are guided in the spring cups 43 immerse into the peripheral groove 41 of the piston rod 36 and are entrained by the stop 50 of the peripheral groove 41. In doing so, the balls 42 get onto a region of the ring 46 having a larger internal diameter, whereby the balls 42, which are pressed radially outwards by the stop 50 of the rod 13, emerge from the peripheral groove 41 and the rod 36 is freely displaceable. The lock position of the closed tongue 2 may, however, be undone only in that with the tube 40 the piston rod 36 is further displaced in the direction of the arrow 48 by the approaching train, whereby the balls 39 get from the larger-diameter region 47 onto the smaller-diameter region 37, whereby also the segments 51 being in the lock position emerge from the locking groove 53 under the force of their springs 52. By displacing the piston rod 36, fluid is pressed out of the working volumes of the cylinder piston unit 9 into the respective working volumes of further units arranged in the direction towards the end of the tongue, thereby enabling unlocking also of these units and hence setting of the switch during approaching of the rolling load. Locking of the then closed switch tongue 3 after approaching, however, is feasible only if, as is the case with the usual setting of a switch during normal operation, the piston rod 36 is displaced into the definitive lock position by the cylinder piston unit 9 in the direction of the arrow 48.

By the active hydraulic setting of a switch, the tube 40 of the open switch tongue 3 at a movement of the piston rod 36 in the direction of the arrow 48 is displaced by the stop 54 cooperating with the balls 39, as illustrated in FIG. 6. The lock of the closed switch tongue 2 is thereby undone in the same manner as in the switching procedure described above by approaching of the switch, whereby the switch may be set. A lock position of the closure of the switch tongue 3 attained after switching in that case will be reached only if the piston rod is displaced by the cylinder piston unit in the direction of the arrow 48 into an end position corresponding to FIG. 7. In doing so, the segments 51 by the stop 54 cooperating with the balls 39 are moved radially outwards into the locking groove against the force of their springs 52, whereupon the balls 39 get onto the full cross section region 47 of the rod 36. At the same time, the balls 42 are pressed onto the smaller internal-diameter region of the ring 46 by the bias of the spring 44 and are immersed in the peripheral groove 41 of the piston rod 36. The bias of the spring 44 finally facilitates the attainment of the end position of the piston rod. That lock position will not be reached by the purely mechanical setting of the switch by approaching, since the tube 40 is unable to displace the piston rod 36 as far as to the attainment of the end position. The lock of the then closed switch tongue 3 must be activated hydraulically when approaching the switch.

Figure 8:
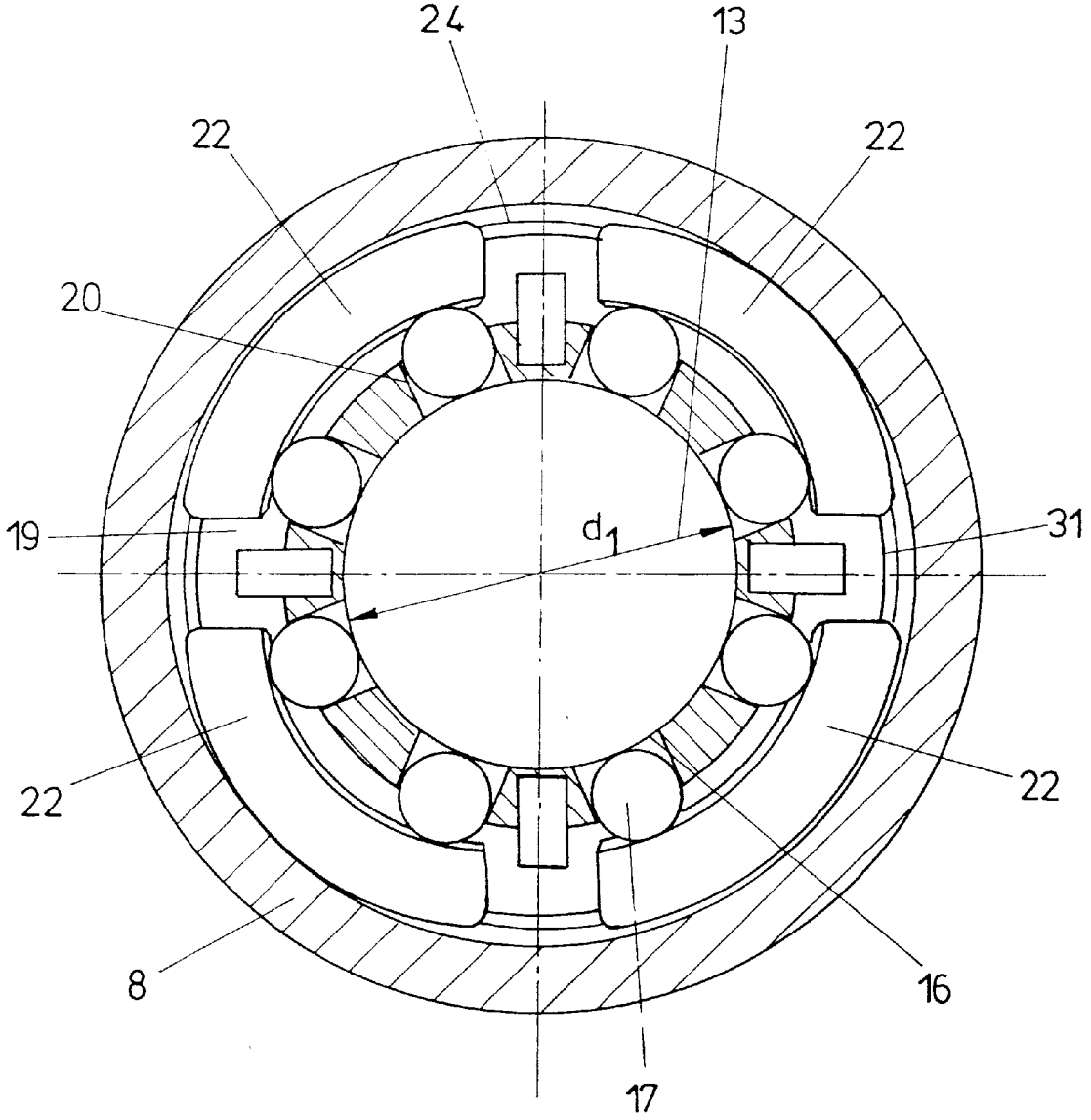
FIG. 8 is a section along line VIII—VIII of FIG. 4.

FIG. 8 is a section through the locking elements in the lock position along line VIII—VIII of FIG. 4. The balls 17 are guided in openings 20 of the tube 19 and supported against segments 22. The segments 22 are pressed radially inwards by springs 24 extending in the circumferential direction. The balls 17 rest on the region 16 of the piston rod 13, designed with the larger diameter $d_1$, the segments 22, thus, immersing into the locking groove 31 out of the tube 19 and the tube 19 being no longer displaceable.

Figure 9:
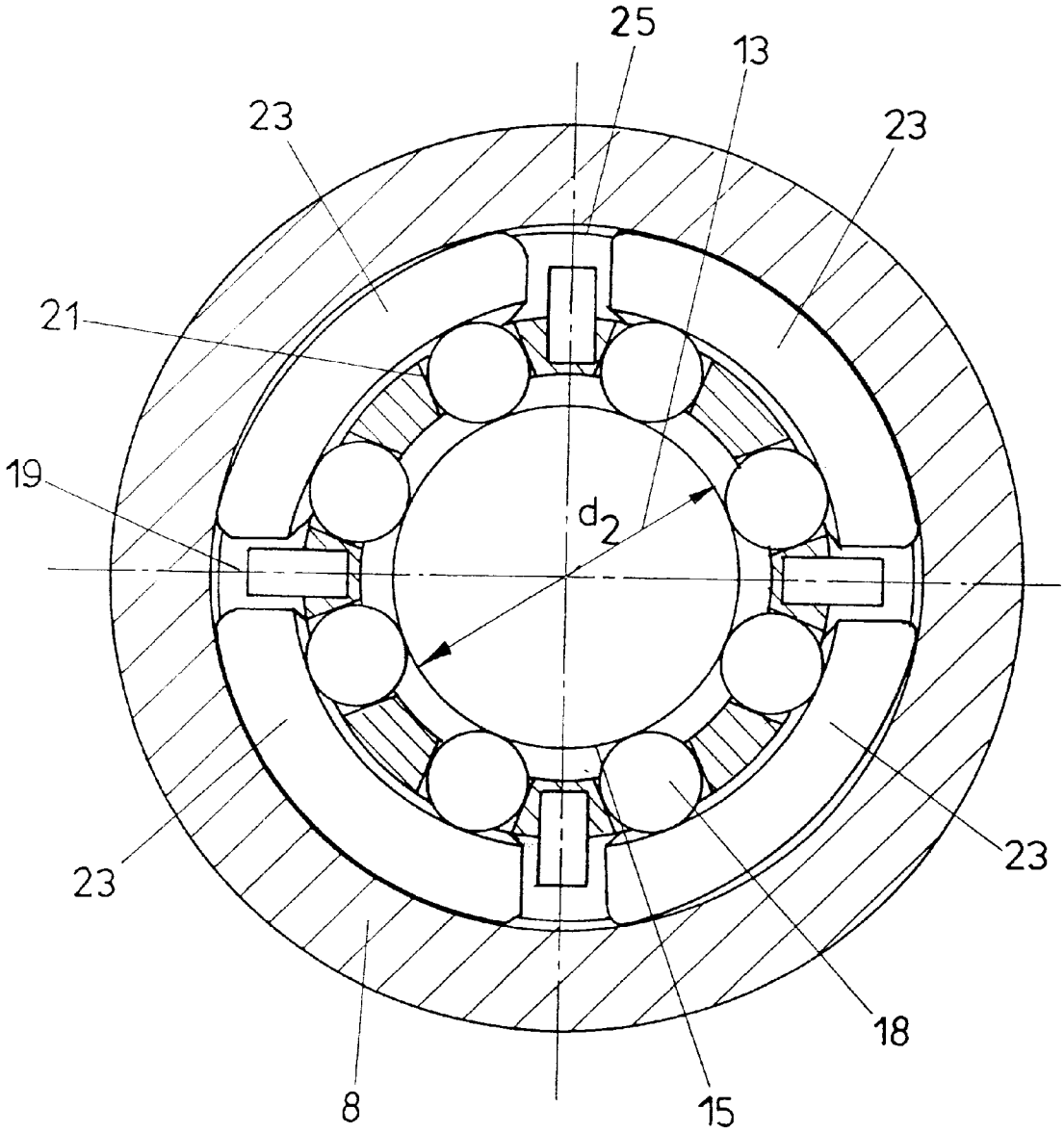
FIG. 9 is a section along line IX—IX of FIG. 4 with the ring segments being in their inward and outward positions, respectively.

FIG. 9 illustrated a section through the locking elements in the unlocked position along line IX—IX of FIG. 4. The balls 18, which are within the openings 21 of the tube 19, rest on the region 15 of the piston rod 13 designed with a smaller diameter $d_2$. The segments 23 are pressed radially inwards by the force of the spring 25, whereby the segments 23 are completely immersed into the groove of the tube 19 and do not project beyond the same. The tube 19, thus, is not locked, whereby the displacement path is released while avoiding friction by the segments on the tube.

What is claimed is:

1. A device for locking the end positions of movable railway switch components, the device being of the type wherein two parts capable of being axially displaced relative to each other are displaceable into a position coupled to each other in a positive and force-transmitting manner in at least one moving direction, wherein the relatively displaceable parts are formed by a tube and a rod guided within the tube and are arranged at least partially within a stationary external tube, and wherein locking ball elements cooperate with the axially displaceable parts and the external tube and are displaceable in a radial direction towards a recess of the external tube to a lock position, the invention comprising an expandable ring which surrounds the balls and which normally is resiliently held in a peripheral groove of the displaceable tube in a position in which the ring has an outer diameter smaller than, or equal to, the outer diameter of the axially displaceable tube, the balls being arranged in openings in the displaceable tube between the rod and the ring.

2. A device according to claim 1, wherein the ring comprises segments having end faces extending normal to an axial displacement direction of the segments or inclined at an acute angle thereto, which end faces cooperate with stops provided in the external tube in the lock position.

3. A device according to claim 1 or 2, wherein resilient holding of the ring segments is obtained by springs extending in a peripheral direction relative to the segments or by a spring band.

4. A device according to claim 1, wherein the rod in an end region thereof comprises two spaced axial regions reduced to smaller rod diameters and an intermediately located axial region having a full rod diameter and an axial length smaller than the distance between balls spaced from one another in an axial direction of the displaceable tube.

5. A device according to claim 1, comprising a pair of axially displaceable tubes respectively connected with separate switch tongues, at least one of said displaceable tubes having openings at an axial distance ($l_1$), which are offset in the axial direction and wherein the external tube comprises at least two stops arranged so as to be opposed to each other at an axial distance ($l_2$)>($l_1$) and located on a radius exceeding the diameter of the at least one displaceable tube, the distance ($l_2$) reduced by the distance ($l_1$) corresponding to the axial displacement path between closed and open end positions of a tongue.

6. A device according to claim 1, wherein the displaceable rod within the tube includes a central region connected with a piston which is drivable in an axially displaceable manner by fluid within the external tube designed to include a cylinder portion of a double-acting cylinder piston unit.

7. A device according to claim 6, wherein the external tube on each side of the cylinder portion comprises an annular recess between a first locking recess adjacent the cylinder portion for locking one end position of the switch parts and a second locking recess for locking the opposite end position of the switch parts, said annular recess having a cross section that is smaller than cross sections of the recesses for locking the end positions.

8. A device according to claim 6 or 7, wherein in an end position of the switch parts, a distance ($l_3$) of balls facing the cylinder portion and resting on a smaller diameter of the rod from a stop formed by an axial region of the rod having a full diameter is larger than a distance ($l_4$) of balls engaging a part of the rod located opposite the cylinder portion from a stop adjacent the latter balls and formed by the axial region of the rod having the full diameter.

9. A device according to claim 1, wherein in an end position of the rod an axial distance ($l_5$) of balls resting on a full cross section of the rod in a lock position to an end-side region of the rod having a smaller diameter is larger than a distance ($l_6$) of balls abutting an opposite end of the rod on the full cross section from an internally arranged stop formed by the full cross section of the rod.

10. A device according to claim 1, wherein the axial width of the recess of the external tube is larger than the axial width of the ring.

11. A device according to claim 6, wherein proximity sensors or displacement path-dependent switches are arranged proximate end faces of the cylinder portion through which the rod passes.

12. A device according to claim 1, wherein an arrangement of a plurality of devices for locking the end positions of the switch parts are positioned in spaced-apart relationship in the longitudinal direction of the railway, at least one device comprising locking elements capable of being displaced against the force of a spring and of being shifted outwards following a predetermined displacement path in an axial direction under the compression of the spring in a radial direction, releasing the further displacement path of its associated rod, and wherein fluid volumes of cylinder piston units of neighboring devices are interconnected to achieve piston displacement in same direction.

13. A device according to claim 12, wherein the spring is designed as a helical spring concentrically surrounding the associated rod and supported between end walls of an associated cylinder piston unit and one spring plate, the spring being displaceable within the associated external tube against a stop, and wherein the spring plate, which is displaceable within the external tube, in a manner distributed about its periphery, carries radially displaceable balls in radial openings of the spring plate.

14. A device according to claim 12 or 13, wherein the rod cooperating with the spring on its end-side carries a head having a diameter exceeding the diameter of the rod, which head cooperates with axially external stops of the tube.

* * * * *